US011591189B2

(12) United States Patent
Liu et al.

(10) Patent No.: US 11,591,189 B2
(45) Date of Patent: Feb. 28, 2023

(54) COUPLING DEVICE BETWEEN AN ELEVATOR CAR DOOR AND A LANDING DOOR AND ELEVATOR SYSTEM

(71) Applicant: Otis Elevator Company, Farmington, CT (US)

(72) Inventors: Zhiren Liu, Shanghai (CN); JinKoo Lee, Yongin-si (KR)

(73) Assignee: OTIS ELEVATOR COMPANY, Farmington, CT (US)

( * ) Notice: Subject to any disclaimer, the term of this patent is extended or adjusted under 35 U.S.C. 154(b) by 75 days.

(21) Appl. No.: 17/085,108

(22) Filed: Oct. 30, 2020

(65) Prior Publication Data

US 2021/0130135 A1 May 6, 2021

(30) Foreign Application Priority Data

Nov. 5, 2019 (CN) ..... 201911071484.8

(51) Int. Cl.
*B66B 13/12* (2006.01)

(52) U.S. Cl.
CPC ..... *B66B 13/12* (2013.01)

(58) Field of Classification Search
CPC ..... B66B 13/12
See application file for complete search history.

(56) References Cited

U.S. PATENT DOCUMENTS 9,132,992 B2 * 9/2015 Walker ..... B66B 13/12

FOREIGN PATENT DOCUMENTS

| | | | | |
|---|---|---|---|---|
| CN | 102666349 A | * | 9/2012 | ..... B66B 13/12 |
| FR | 2823495 A1 | * | 10/2002 | ..... B66B 13/20 |
| WO | 2017023928 A1 | | 2/2017 | |

* cited by examiner

*Primary Examiner* — Diem M Tran
(74) *Attorney, Agent, or Firm* — Cantor Colburn LLP

(57) ABSTRACT

A linkage device used between an elevator car door and a hall door, and an elevator system. The linkage device includes: a link mechanism; a first door vane and a second door vane that are connected to the link mechanism; and an actuating mechanism for actuating the link mechanism so that the first door vane and the second door vane are switched between a contracted position and an expanded position; wherein the link mechanism includes: a first link and a second link arranged in parallel, each of which includes a link body and a slider; the link body of the first link and the link body of the second link are pivotally connected to the car door, and the slider of the first link and the slider of the second link are each capable of sliding along a passage defined by the corresponding link body.

12 Claims, 8 Drawing Sheets

COUPLING DEVICE BETWEEN AN ELEVATOR CAR DOOR AND A LANDING DOOR AND ELEVATOR SYSTEM

FOREIGN PRIORITY

This application claims priority to Chinese Patent Application No. 201911071484.8, filed Nov. 5, 2019, and all the benefits accruing therefrom under 35 U.S.C. § 119, the contents of which in its entirety are herein incorporated by reference.

TECHNICAL FIELD OF INVENTION

The present disclosure relates to the field of elevators, and more particularly, the present disclosure relates to a linkage device used between an elevator car door and a hall door, and an elevator system having the same.

BACKGROUND OF THE INVENTION

In a common elevator system, an elevator car includes a car door, and a floor hall on each floor includes a hall door. In order to ensure the safety of elevator, the hall door of the floor hall can be opened only when the car is on that floor. In a common design, a linkage device is disposed on the car door of the elevator car. When the car is stopped on a certain floor, the linkage device can couple the car door with the hall door of the hall on that floor, so that the hall door of the floor hall is driven by the car door to be opened and closed. In this coupling process, if the car door moves first before the linkage device completes the coupling, a change of a moving trajectory of a lock hook of the car door may be caused, making the car door cannot be unlocked.

SUMMARY OF THE INVENTION

Therefore, the object of the present disclosure is to solve or at least alleviate the problems existing in the related art.

In one aspect, a linkage device used between an elevator car door and a hall door is provided, which includes: a link mechanism; a first door vane and a second door vane that are connected to the link mechanism; and an actuating mechanism for actuating the link mechanism so that the first door vane and the second door vane are switched between a contracted position and an expanded position; wherein the link mechanism includes: a first link and a second link, wherein the first link and the second link are arranged in parallel, and each of the first link and the second link includes a link body and a slider; the link body of the first link and the link body of the second link are pivotally connected to the car door, and the slider of the first link and the slider of the second link are each capable of sliding along a passage defined by the corresponding link body; and the slider of the first link and the slider of the second link each include a first end pivotally connected to the first door vane and a second end pivotally connected to the second door vane.

Optionally, in some embodiments, the slider includes a rod portion between the first end and the second end of the slider, such as a cylindrical rod portion, and the rod portion is fitted into the passage of the link body having a corresponding shape.

Optionally, in some embodiments, the first link and the second link include a support spring for supporting the slider.

Optionally, in some embodiments, the support spring surrounds the rod portion of the slider, a first end of the support spring abuts against the first end of the slider, and a second end of the support spring is located in the passage; the passage includes a first portion, and a second portion adjacent to the first end of the slider with larger diameter, and the second end of the support spring abuts against a step at an interface of the first portion and the second portion of the passage.

Optionally, in some embodiments, the link body of the first link and the link body of the second link each include a first end and a second end, wherein the first ends of the link bodies of the first link and the second link are pivotally connected to a third link, the second ends of the link bodies of the first link and the second link are pivotally connected to a fourth link, and the fourth link includes an upper end so as to be connected with the actuating mechanism.

Optionally, in some embodiments, the actuating mechanism includes a fifth link that is pivotally connected to the car door, wherein a first end of the fifth link is connected to a pulley actuator, and a second end of the fifth link is pivotally connected to an actuating end of the fourth link.

Optionally, in some embodiments, the fourth link further includes a lower end, and a tension spring is further disposed between the lower end of the fourth link and the car door.

Optionally, in some embodiments, the linkage device further includes a stop member, wherein the stop member is fixed to the car door, and the stop member is arranged in such a manner that when the first door vane and the second door vane are in the expanded position, the stop member abuts against the slider of the first link and/or the slider of the second link so as to prevent the slider from sliding relative to the link body.

Optionally, in some embodiments, the stop member includes an elastic end portion, and when the first door vane and the second door vane are in the expanded position, the elastic end portion of the stop member abuts against the rod portion between the first end and the second end of the slider, so that the rod portion is tightly clamped between the elastic end portion of the stop member and a boss of the link body.

Optionally, in some embodiments, the link body includes a flat first end, a flat second end, and a raised portion between the first end and the second end, wherein the raised portion defines the passage and has a notch on one side of the passage so that a part of the rod portion of the slider is exposed, and the stop member acts on said part of the rod portion.

In another aspect, an elevator system is provided, which includes the linkage device according to various embodiments.

BRIEF DESCRIPTION OF THE DRAWINGS

Hereinafter, embodiments according to the present disclosure will be explained with reference to the accompanying drawings. The contents of the present disclosure will become easier to understand with reference to the accompanying drawings.

DETAILED DESCRIPTION OF THE INVENTION

Figure 1:
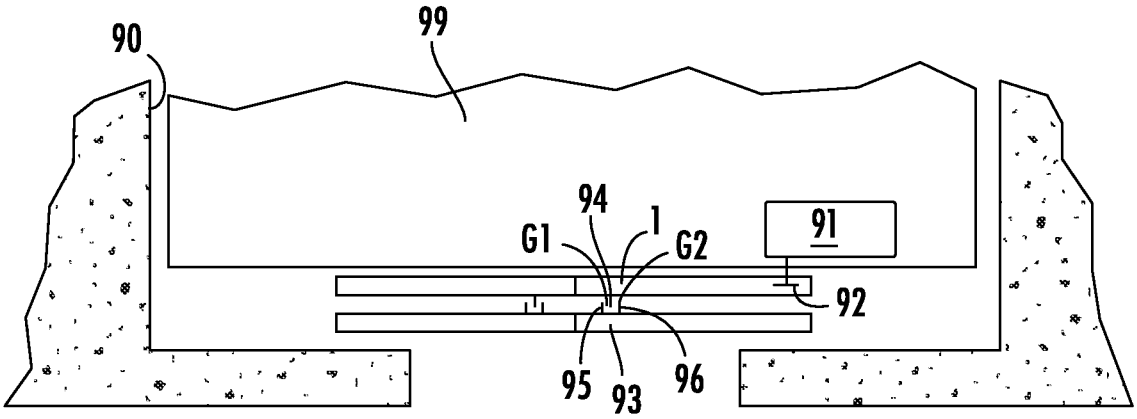
FIGS. 1 and 2 show schematic cross-sectional views of an elevator system according to an embodiment when a door is closed and when the door is partially opened, respectively.
Figure 2:
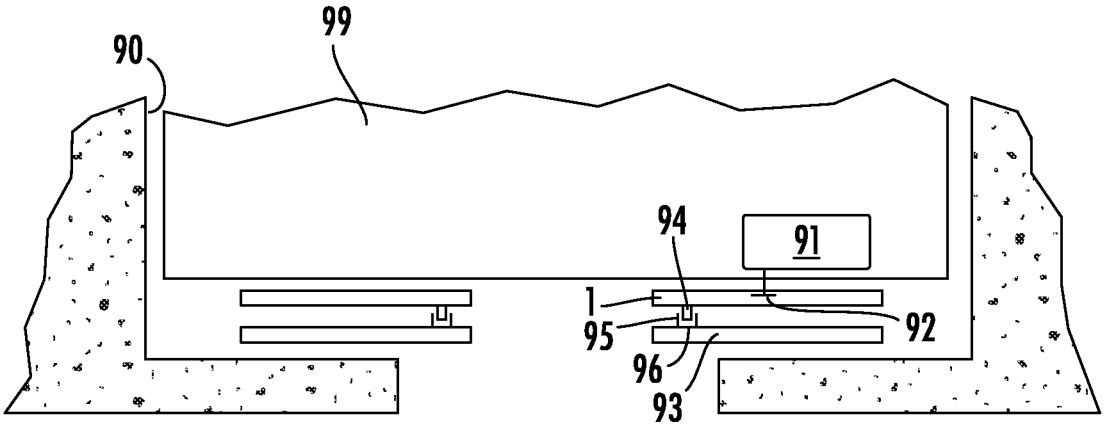

Referring first to FIGS. 1 and 2, an elevator system to which a linkage device used between an elevator car door and a hall door according to an embodiment of the present disclosure can be applied is shown. FIG. 1 shows an elevator car 99 in a vertical hoistway 90. The elevator car has a car door 1, which is opened and closed by being driven by a door operator 91 and a belt drive 92 or by other devices. When the elevator stops at different floors, the car door 1 of the elevator car may be aligned with the hall doors of different floors, such as the hall door 93 in FIG. 1. A linkage device 94 used between the car door 1 of the elevator car and the hall door 93 is arranged on the car door. If the car door is a hanging door, the linkage device 94 may be arranged on the door head of the car door. The linkage device 94 may be switched between a contracted position shown in FIG. 1 and an expanded position shown in FIG. 2. In the contracted position, the linkage device 94 of the car door 1 is separated from protrusions 95, 96 of the hall door 93 (hereinafter, door rollers will be used as an example; in alternative embodiments, the protrusions 95, 96 may take other forms), and there are gaps G1 and G2 between the linkage device 94 and the protrusions 95, 96 to allow the car to ascend or descend in a vertical direction. As shown in FIG. 2, in the expanded position, the linkage device 94 of the car door 1 is expanded to be coupled with the protrusions 95, 96 of the hall door 93, so that the opening of the car door 1 can cause the hall door 93 to open. During the opening and closing of the elevator door, the car door 1 and the hall door 93 are always coupled until the elevator door is closed and then the linkage device is contracted to the contracted position shown in FIG. 1; the elevator can ascend or descend in the vertical direction along the hoistway to arrive at other floors, and the door can be opened and closed on other floors in a similar manner.

Figure 3:
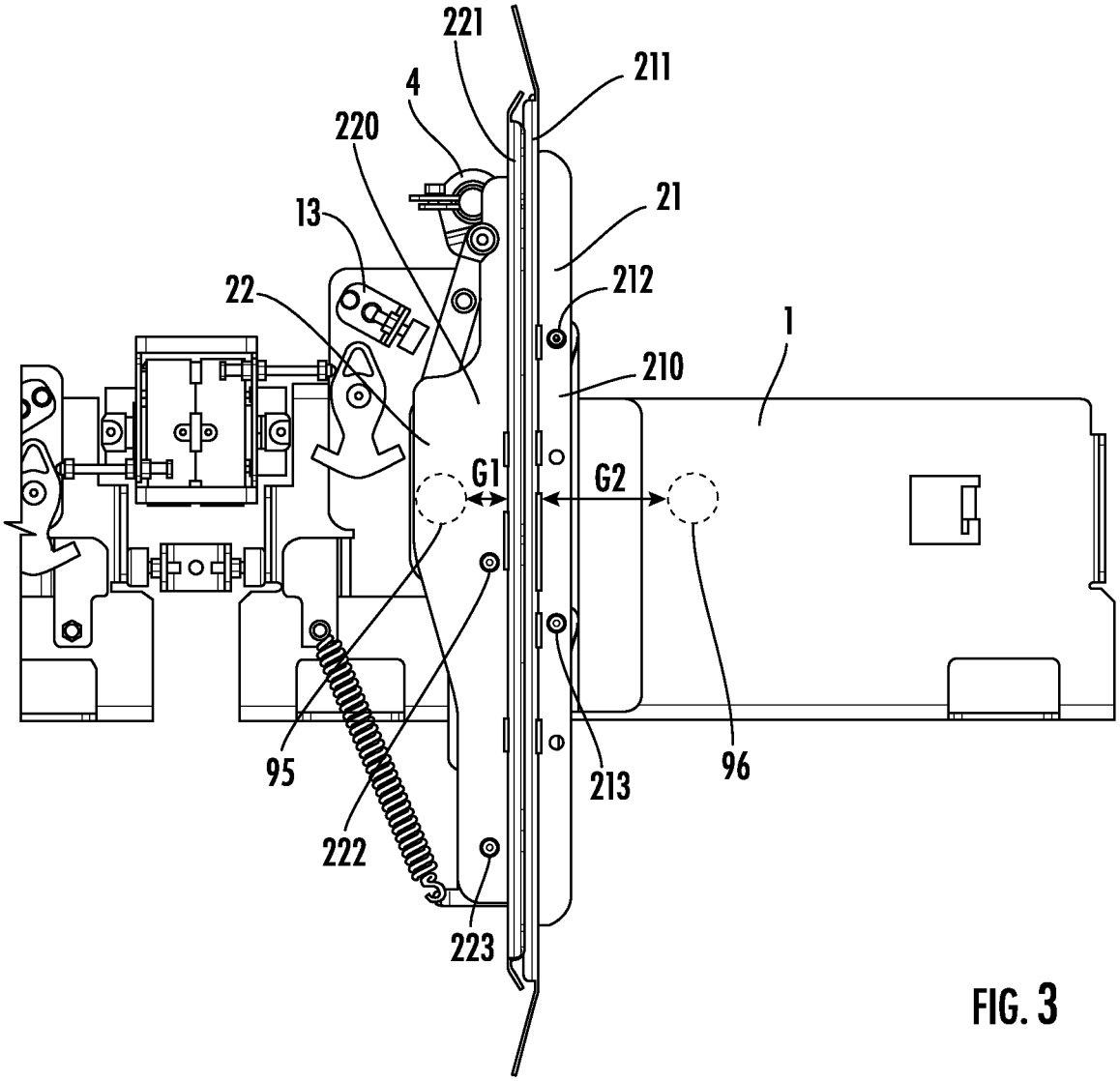
FIG. 3 shows a front view of a linkage device according to an embodiment of the present disclosure.

Next, with reference to FIG. 3 to FIG. 5, the linkage device according to the embodiment of the present disclosure will be described. The linkage device includes: a link mechanism; a first door vane 21 and a second door vane 22 that are connected to the link mechanism; and an actuating mechanism 4 for actuating the link mechanism so that the first door vane 21 and the second door vane 22 are switched between a contracted position and an expanded position. In the illustrated embodiment, the first door vane 21 and the second door vane 22 include flat portions 210, 220 and working portions 211, 221 perpendicular to the flat portions 210, 220, respectively. The flat portions 210, 220 of the first door vane 21 and the second door vane 22 are pivotally connected to the link mechanism at pivot positions 212, 213, 222 and 223. When the linkage device is fully expanded, the working portion 211 of the first door vane 21 engages with a protrusion such as the first door roller 96 on the hall door, and the working portion 221 of the second door vane 22 engages with the second door roller 95 on the hall door. At this point, the movement of the car door 1 will drive the hall door 93 to move so that the opening and closing of the elevator system is realized. After the elevator completes the closing of the door, the first door vane 21 and the second door vane 22 of the linkage device are retracted to the contracted position shown in FIG. 3; at this point, there are gaps G2 and G1 between the working portions 211, 221 of the first door vane 21 and the second door vane 22, and the first and second door rollers 96 and 95, respectively, thereby allowing the elevator car to move in the vertical direction without interfering with the hall door.

A normal link mechanism includes four working links in a parallelogram structure and an actuating link. The actuating link can change a distance of a pair of vertically arranged links of the four working links so that the first door vane 21 and the second door vane 22 respectively mounted to the pair of vertically arranged links are switched between the contracted position and the expanded position. In the situation shown in FIG. 3, that is, when the distance G2 between the working portion 211 of the first door vane 21 and the first door roller 96 is significantly larger than the distance G1 between the working portion 221 of the second door vane 22 and the second door roller 95, such a link mechanism will cause the car door 1 to move before the link mechanism is completely expanded; however, the car door 1 is actually unlocked by means of the expanding of the link mechanism. Therefore, the movement of the car door 1 before the link mechanism is completely expanded may cause the car door to fail to be unlocked. In this case, there is a high requirement on mounting positions of the door rollers of the hall door on each floor, which need to be manually adjusted during the mounting; as described below, the present application provides an improved link mechanism.

Figure 4:
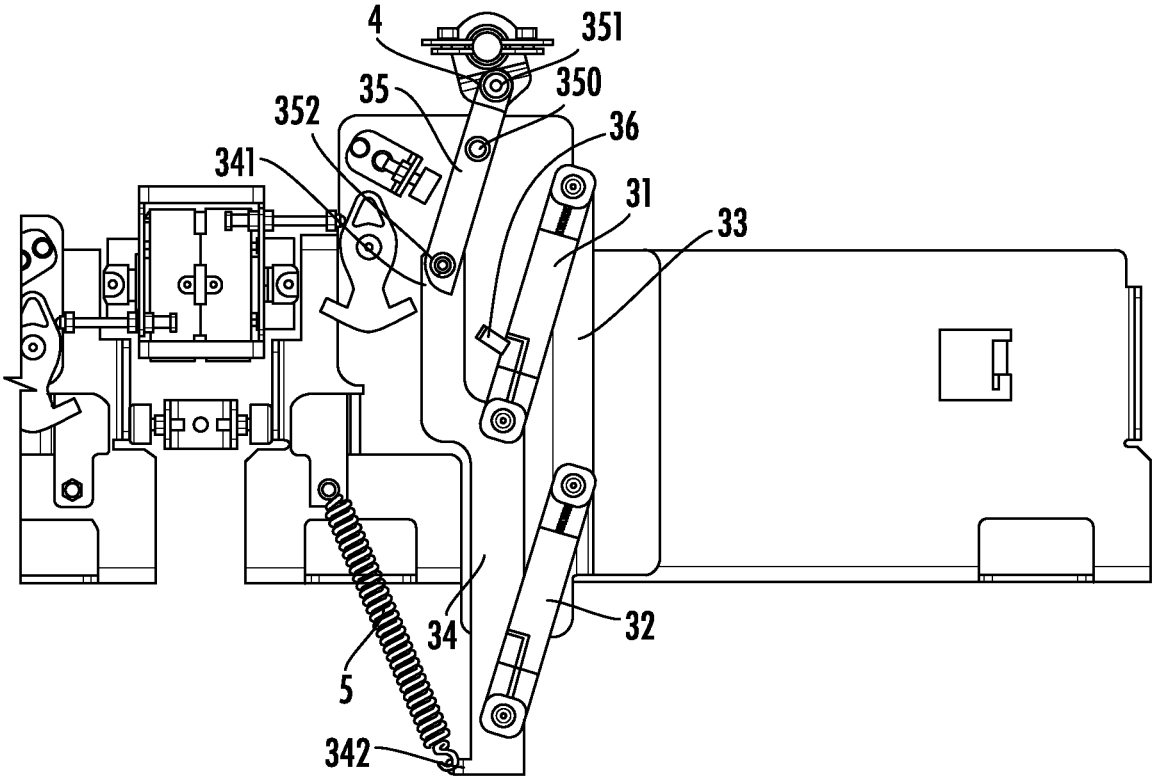
FIG. 4 shows a front view of a linkage device according to an embodiment of the present disclosure, with door vanes removed to show a link mechanism.
Figure 5:
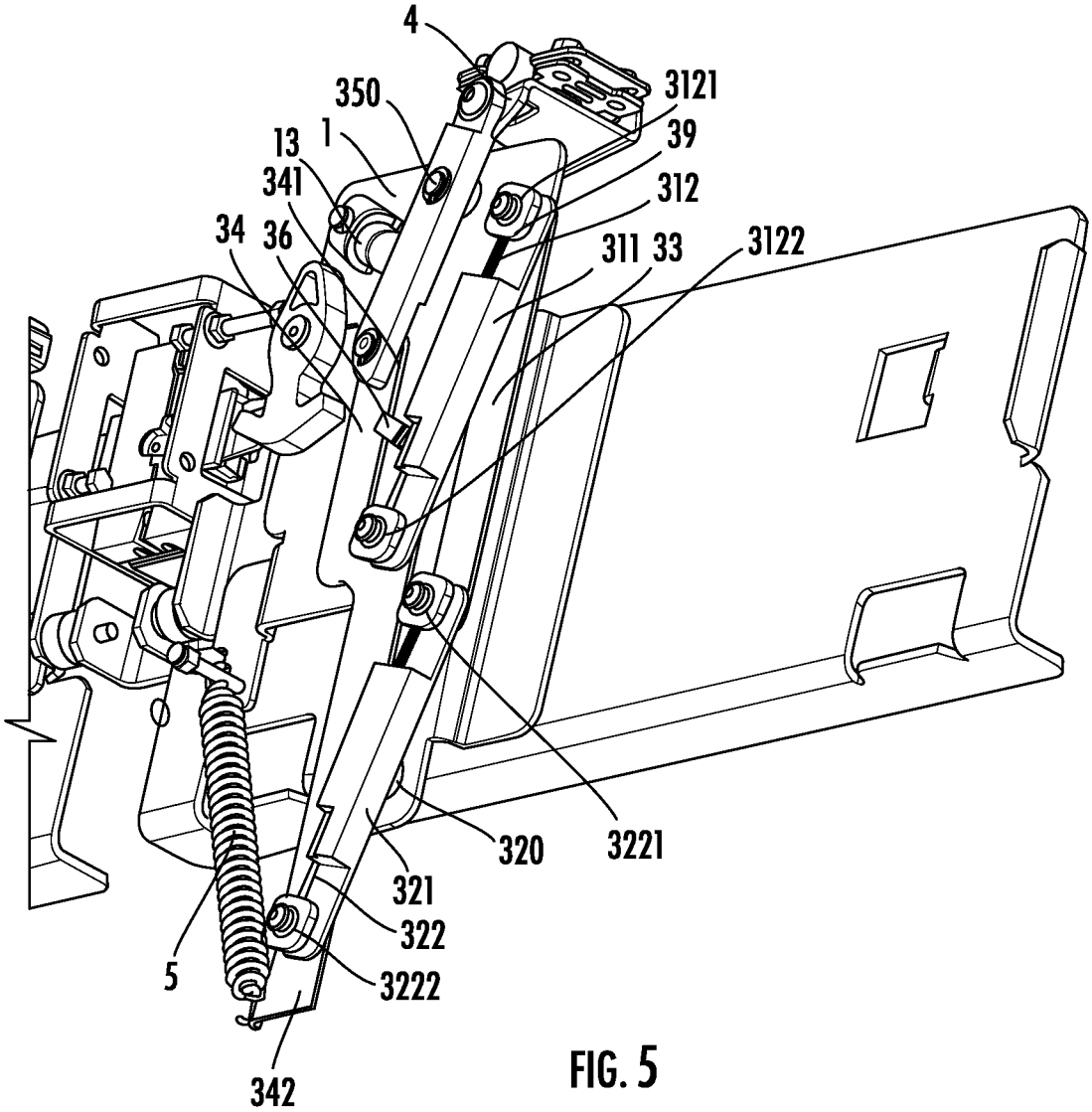
FIG. 5 shows a perspective view of a linkage device according to an embodiment of the present disclosure viewed at an angle, with door vanes removed to show a link mechanism.

FIGS. 4 and 5 show views of the link mechanism according to an embodiment of the present disclosure. The link mechanism includes a first link 31 and a second link 32 which are arranged in parallel with each other. Unlike normal links, the first link 31 and the second link 32 according to the embodiment of the present disclosure each include link bodies 311, 321 and sliders 312, 322, and the link bodies 311, 321 of the first link and the second link are pivotally connected to the car door 1. As shown in FIG. 5, the link body 321 of the second link 32 is pivotally connected to the car door 1 at a pivot shaft 320; the pivotal connection position of the link body 311 of the first link 31 is not visible in FIG. 5 since it is blocked by a third link 33, and it can be located on the same vertical axis as the pivot shaft 320. The sliders 312, 322 of the first and second links 31 and 32 can slide along passages defined by the corresponding link bodies 311, 321, and the sliders 312, 322 of the first and second links 31 and 32 respectively include first ends 3121, 3221 pivotally connected to the first door vane 21 and second ends 3122, 3222 pivotally connected to the second door vane 22, as can be seen in FIG. 5. Since the first door vane 21 and the second door vane 22 are only pivotally connected to the sliders in the present application, an entirety formed by the first door vane 21 and the second door vane 22 together with the sliders 312 and 322 is capable of sliding relative to the link bodies 311, 321 of the first link and the second link.

Figure 7:
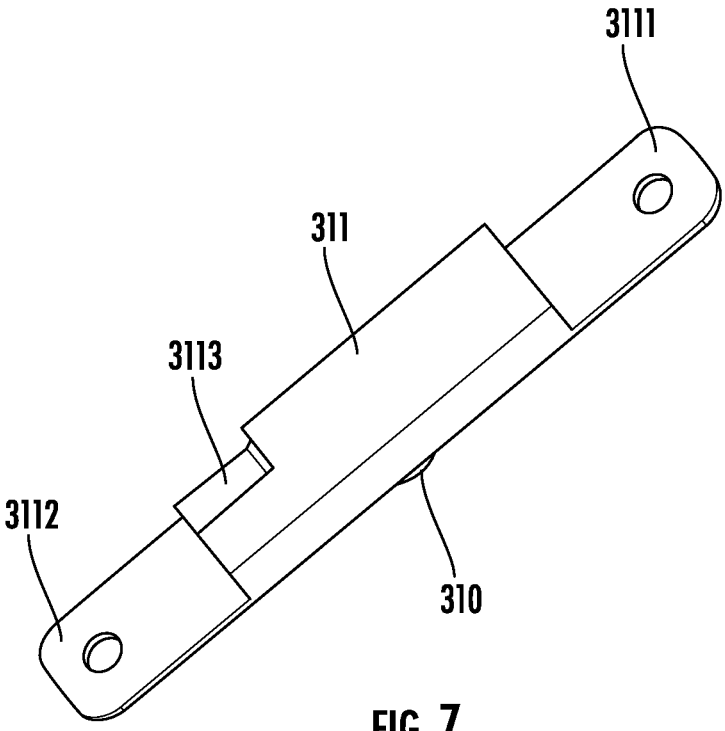
FIG. 7 shows a perspective view of a link body of a first link of a linkage device according to an embodiment of the present disclosure.
Figure 8:
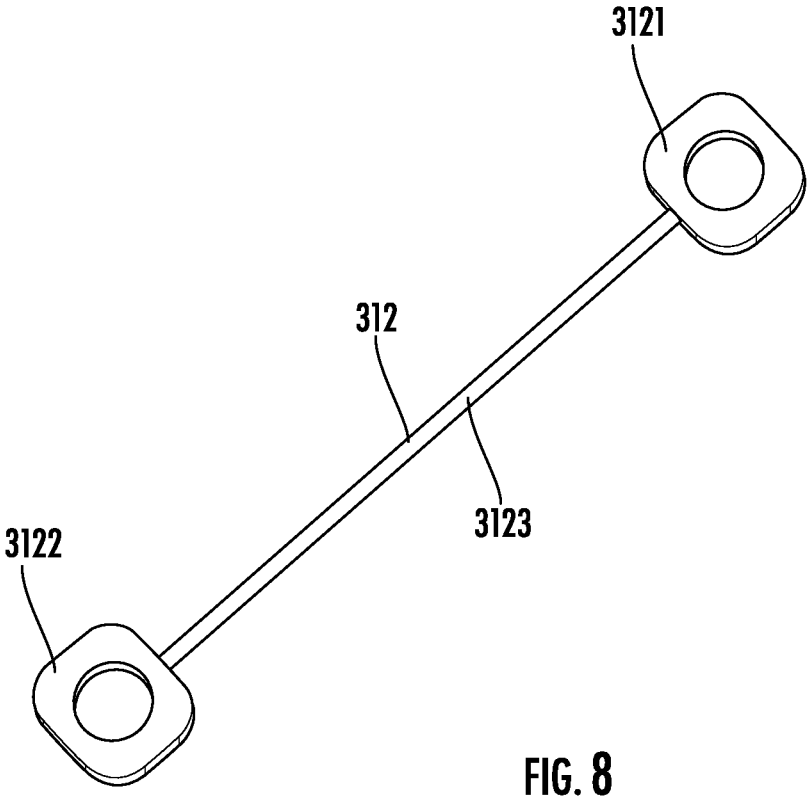
FIG. 8 shows a perspective view of a slider of a first link of a linkage device according to an embodiment of the present disclosure.
Figure 9:
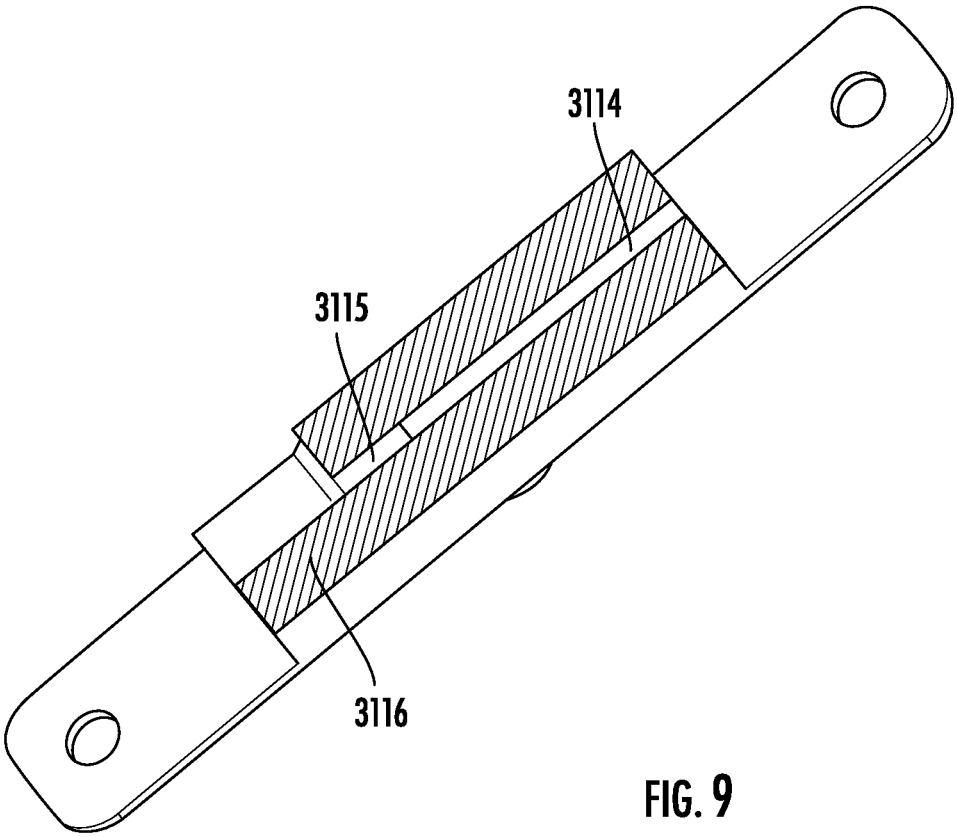
FIG. 9 shows a cross-sectional view of a link body of a first link of a linkage device according to an embodiment of the present disclosure.

Since the same or similar structure may be applied to the first link 31 and the second link 32, the structure of the first link 31 will be described in detail below with reference to FIGS. 7 to 9. The first link 31 includes a link body 311, a slider 312, and an optional support spring 39. As shown in FIG. 7, the link body 311 may include a flat first end 3111 and a flat second end 3112, as well as a raised portion between the first end 3111 and the second end 3112. The first end 3111 and the second end 3112 of the link body may include mounting holes for pivotal connection. As shown in FIG. 8, the slider 312 includes a first end 3121, a second end 3122, and a rod portion between the first end 3121 and the second end 3122, such as a cylindrical rod portion. Similarly, the first end 3121 and the second end 3122 of the slider 312 may include mounting holes for pivotal connection. The cylindrical rod portion of the slider 312 can be fitted into the passage having a matching shape defined by the raised portion of the link body 311 so that the slider 312 can slide relative to the link body 311. With continued reference to FIG. 9, it can be seen in the cross-sectional view that in some embodiments, the raised portion may define a two-section passage therein, and the passage includes a first portion 3115 having a smaller diameter and a second portion 3114 closer to the first end of the slider and having a larger diameter, wherein the first portion 3115 of the passage has a comparable size (slightly larger to allow for sliding) to the rod portion of the slider, and the diameter of the second portion 3114 of the passage is slightly larger than the rod portion of the slider for receiving the support spring 39 surrounding the rod portion. The support spring 39 serves to support the slider 312 in a balanced position so that the slider 312 does not slide down to the lowest position under the action of its own gravity and carried load (such as the weight of the door vanes). In some embodiments, the support spring 39 may be arranged to have a small stiffness but a large amount of pre-compression, such as at least 50%, so that it can carry the weights of the slider and the door vane, and during the expanding process of the door vane, it can allow the slider to slide relative to the link body due to the extra force. In some embodiments, the support spring 39 surrounds the rod portion of the slider, a first end of the support spring 39 abuts against the first end 3121 of the slider, a second end of the support spring 39 is located in the passage, and the second end of the support spring 39 may abut against a step at an interface of the first portion 3115 and the second portion 3114 of the passage. In alternative embodiments, the support spring 39 may have other forms, such as a tension spring that pulls the second end 3122 of the slider or another form of spring that gives the slider an elastic support force.

Figure 6:
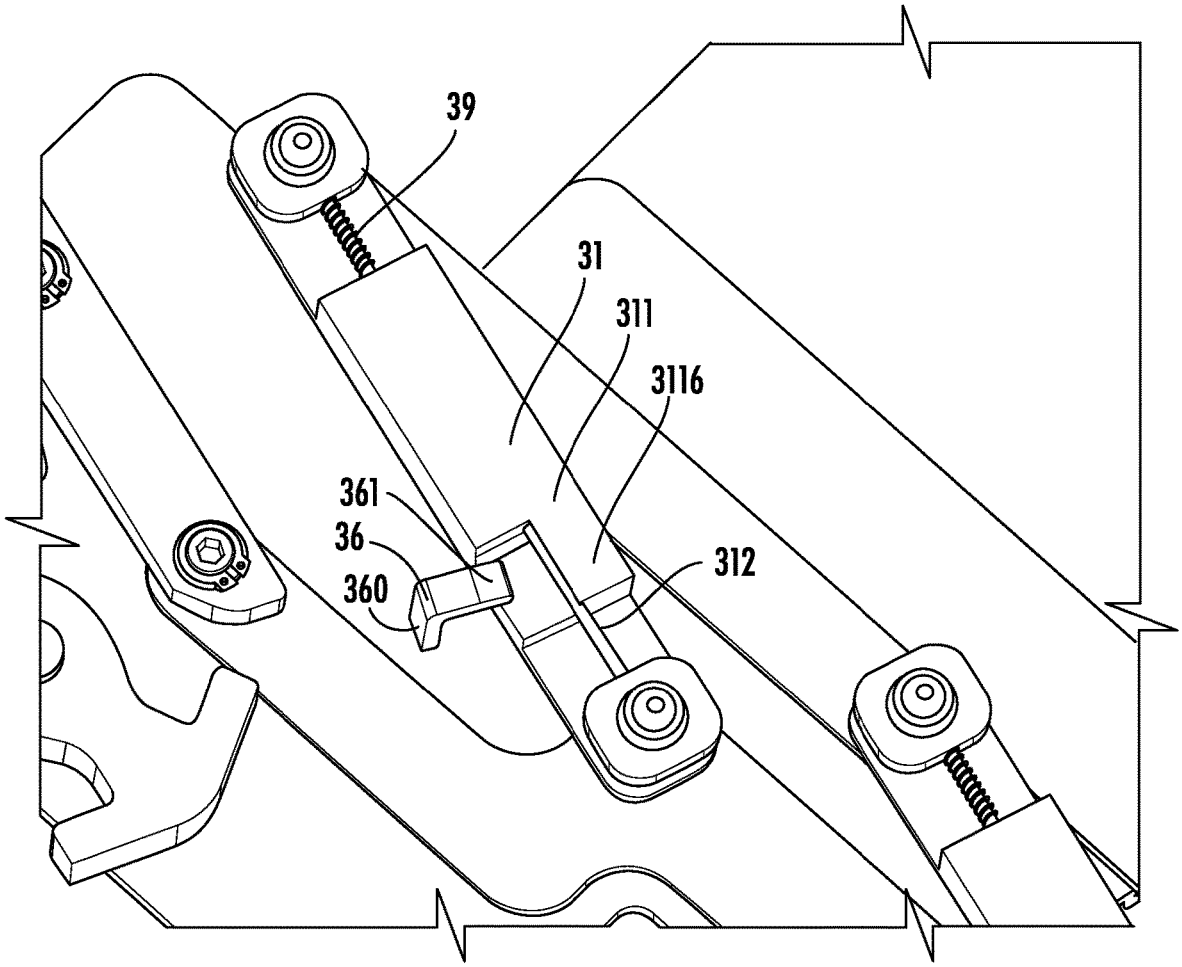
FIG. 6 shows a partial perspective view of a linkage device according to an embodiment of the present disclosure, with door vanes removed to show a link mechanism.

In some embodiments, the linkage device may further include a stop member 36 (best shown in FIGS. 5 and 6). The stop member 36 is fixed to the car door 1, and the stop member 36 is arranged in such a manner that when the first door vane 21 and the second door vane 22 are in the expanded position, the stop member 36 abuts against the slider 312 of the first link 31 and/or the slider 322 of the second link 32 so as to prevent the sliders 312, 322 from further sliding relative to the link bodies 311, 321, that is, to lock the sliders tightly in the expanded position. As shown more clearly in FIG. 6, in some embodiments, the stop member 36 includes a rigid mounting portion 360 and an elastic end portion 361; when the first door vane 21 and the second door vane 22 are in the expanded position (i.e., the link body 311 of the first link 31 is further rotated clockwise from the position shown in FIG. 6 by a certain angle so that the rod portion of the slider 312 contacts the elastic end portion 361 of the stop member), the elastic end portion 361 of the stop member 36 abuts against the rod portion between the first end and the second end of the slider 312 such that the rod portion is tightly clamped between the elastic end portion 361 of the stop member 36 and a boss 3116 of the link body. In some embodiments, as shown in FIG. 9, the raised portion of the link body 311 has a notch on one side of the passage 3115 so that a part of the rod portion of the slider is exposed, and the stop member acts on said part of the rod portion. In alternative embodiments, the stop member 36 may be arranged at other suitable positions. In some embodiments, the position of the stop member 36 is set such that when the first door vane 21 and the second door vane 22 approach the expanded position, the elastic end portion 361 of the stop member 36 contacts the slider of the first link or the second link, whereas as the first door vane 21 and the second door vane 22 are further expanded to reach the expanded position, the elastic end portion 361 of the stop member 36 is compressed, thereby giving the slider a greater frictional force and suppressing further movement of the slider.

In some embodiments, in order to actuate the first link 31 and the second link 32 and to improve a synergy between the first link 31 and the second link 32, the first ends 3111 of the link bodies 311, 321 of the first link 31 and the second link 32 are pivotally connected to the third link 33, and the second ends 3112 of the link bodies of the first link 31 and the second link 32 are pivotally connected to a fourth link 34. The fourth link 34 includes an upper end 341 to be connected with the actuating mechanism 4. In some embodiments, the actuation mechanism 4 includes a fifth link 35 that is pivotally connected to the car door 1 on a pivot shaft 350, a first end 351 of the fifth link is connected to a pulley actuator, and a second end 352 of the fifth link 35 is pivotally connected to the upper end 341 of the fourth link 34. In some embodiments, the fourth link 34 further includes a lower end 342, and a tension spring 5 is further disposed between the lower end 342 of the fourth link and the car door to ensure a normal expanding of the link mechanism and the door vanes.

Figure 10:
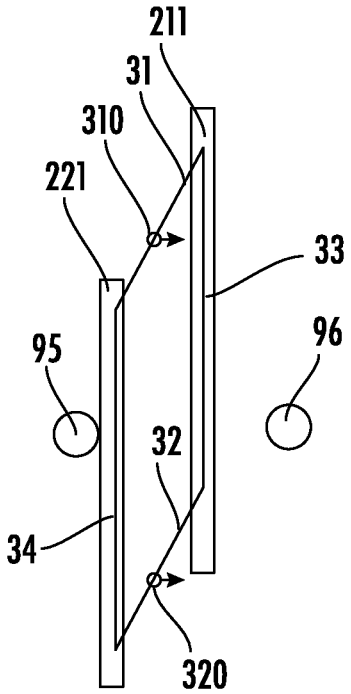
FIG. 10 to FIG. 12 are schematic views showing the evolution of an expanding process of the linkage device according to the embodiment of the present disclosure and that of a conventional linkage device, when gaps between the linkage device and two sides are uneven.
Figure 11:
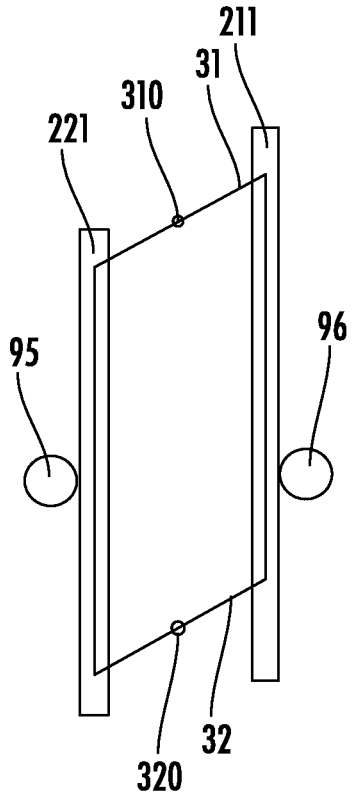
Figure 12:
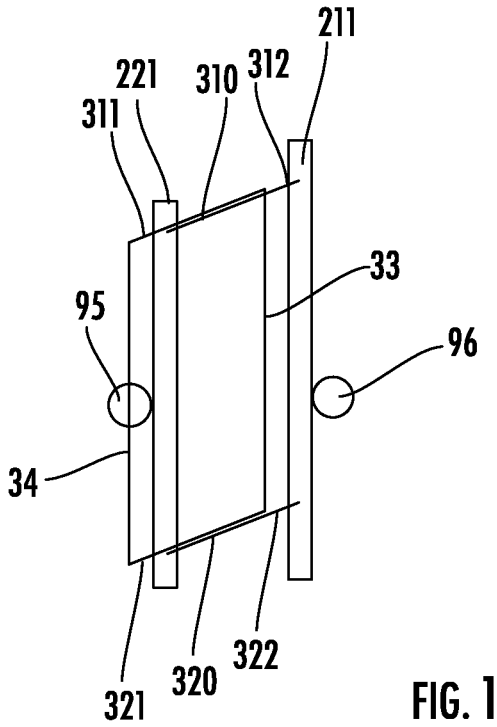

Finally, how the present application realizes that the car door remains stationary before the link mechanism is completely expanded in a case where the distance G2 between the first door roller 96 and the working portion 211 of the first door vane 21 is significantly larger than the distance G1 between the second door roller 95 and the working portion 221 of the second door vane 22 will be explained with reference to FIGS. 10 to 12. FIG. 10 shows that in the above working condition, when the link mechanism is expanded (that is, the first link 31 and the second link 32 rotate clockwise around the pivot shafts 310 and 320, respectively) to such an extent that the working portion 221 of the second door vane 22 is engaged with the second door roller 95, the door roller 95 fixed in the hall door cannot move to the left, so that a further expanding of the link mechanism is impeded. At this point, if the first link 31 and the second link 32 are normal links, due to the rigid connection, the second door roller 95 will exert a reaction force on the link mechanism to push the pivot shafts 310, 320 of the first link 31 and the second link 32 and thereby push the car door 1 to translate rightward to the state shown in FIG. 11. Therefore, in the case of normal links, the car door 1 will move to the state shown in FIG. 11 before the hall door, and in this state, since the working portion 211 of the first door vane 21 and the first door roller 96 are also engaged, a further movement of the car door 1 can drive the hall door. It can be seen that in the case of normal first link 31 and second link 32, the car door will move earlier than the hall door in the above working condition. However, in a case where the first link 31 and the second link 32 according to the embodiment of the present disclosure are used, since it is the two ends of the sliders of the first link 31 and the second link 32 that are pivotally connected to the first door vane 21 and the second door vane 22, even if the second door vane 22 is engaged with the second door roller 95, since the entirety composed of the above-mentioned door vanes and the sliders 312, 322 can slide relative to the link bodies 311, 321, the link mechanism is enabled to continue to expand (i.e., it continues to rotate clockwise) without moving the pivoting shafts 310, 320 of the link bodies of the first link and the second link until the working portion 211 of the first door vane 21 and the first door roller 96 are engaged. At this point, as described above, the stop member 36 will act on the slider 312 of the first link 31, so that the slider 312 of the first link 31 is not capable of sliding relative to the link body 311 in the expanded position. That is, the link mechanism is tightly locked in the expanded position. Throughout this entire expanding process, the pivot shafts 310, 320 of the link bodies 311, 321 of the first link 31 and the second link 32 remain stationary, that is, the car door 1 does not move either. After that, the car door will drive the hall door to move together, thereby opening and closing the elevator door. Therefore, in a case where the distance G2 between the first door roller 96 and the working portion 211 of the first door vane 21 is significantly larger than the distance G1 between the second door roller 95 and the working portion 221 of the second door vane 22, the linkage device according to the embodiment of the present disclosure can still operate normally, which reduces the requirements on the assembly position of the hall door.

The specific embodiments described above are merely for describing the principle of the present disclosure more clearly, and various components are clearly illustrated or depicted to make it easier to understand the principle of the present disclosure. Those skilled in the art can readily make various modifications or changes to the present disclosure without departing from the scope of the present disclosure. It should be understood that these modifications or changes should be included within the scope of protection of the present disclosure.

What is claimed is:

1. A linkage device used between an elevator car door and a hall door, comprising:

a link mechanism;

a first door vane and a second door vane that are connected to the link mechanism; and an actuating mechanism for actuating the link mechanism so that the first door vane and the second door vane are switched between a contracted position and an expanded position;

characterized in that the link mechanism comprises:

a first link and a second link, wherein the first link and the second link are arranged in parallel, and each of the first link and the second link comprises a link body and a slider; the link body of the first link and the link body of the second link are pivotally connected to the car door, and the slider of the first link and the slider of the second link are each configured to slide along a passage defined by the corresponding link body; and the slider of the first link and the slider of the second link each comprise a first end pivotally connected to the first door vane and a second end pivotally connected to the second door vane.

2. The linkage device according to claim 1, wherein the slider comprises a rod portion between the first end and the second end of the slider and the rod portion is fitted into a passage of the link body having a corresponding shape.

3. The linkage device according to claim 2, wherein the first link and the second link comprise a support spring for supporting the slider.

4. The linkage device according to claim 3, wherein the support spring surrounds the rod portion of the slider, a first end of the support spring abuts against the first end of the slider, and a second end of the support spring is located in the passage; the passage comprises a first portion, and a second portion adjacent to the first end of the slider with larger diameter, and the second end of the support spring abuts against a step at an interface of the first portion and the second portion of the passage.

5. The linkage device according to claim 1, wherein the link body of the first link and the link body of the second link each comprise a first end and a second end, the first ends of the link bodies of the first link and the second link are pivotally connected to a third link, the second ends of the link bodies of the first link and the second link are pivotally connected to a fourth link, the link bodies of the first link and the second link form a parallelogram structure together with the third link and the four link, and the fourth link comprises an upper end so as to be connected with the actuating mechanism.

6. The linkage device according to claim 5, wherein the actuating mechanism comprises a fifth link that is pivotally connected to the car door, a first end of the fifth link is connected to a pulley actuator, and a second end of the fifth link is pivotally connected to an actuating end of the fourth link.

7. The linkage device according to claim 5, wherein the fourth link further comprises a lower end, and a tension spring is further disposed between the lower end of the fourth link and the car door.

8. The linkage device according to claim 1, wherein the linkage device further comprises a stop member, the stop member is fixed to the car door, and the stop member is arranged in such a manner that when the first door vane and the second door vane are in the expanded position, the stop member abuts against the slider of the first link and/or the slider of the second link so as to prevent the slider from sliding relative to the link body.

9. The linkage device according to claim 8, wherein the stop member comprises an elastic end portion, and when the first door vane and the second door vane are in the expanded position, the elastic end portion of the stop member abuts against the rod portion between the first end and the second end of the slider, so that the rod portion is tightly clamped between the elastic end portion of the stop member and a boss of the link body.

10. The linkage device according to claim 9, wherein the link body comprises a flat first end, a flat second end, and a raised portion between the first end and the second end, the raised portion defines the passage and has a notch on one side of the passage so that a part of the rod portion of the slider is exposed, and the stop member acts on said part of the rod portion.

11. An elevator system, comprising the linkage device according to claim 1.

12. The linkage device according to claim 1, wherein the first link and the second link expand in length when transitioning between the contracted position and the expanded position.

* * * * *